US008267191B2

(12) United States Patent
Furusawa et al.

(10) Patent No.: US 8,267,191 B2
(45) Date of Patent: Sep. 18, 2012

(54) IMPACT TOOL

(75) Inventors: Masanori Furusawa, Anjo (JP); Yoshihiro Kasuya, Anjo (JP)

(73) Assignee: Makita Corporation, Anjo-shi (JP)

( * ) Notice: Subject to any disclaimer, the term of this patent is extended or adjusted under 35 U.S.C. 154(b) by 157 days.

(21) Appl. No.: 12/671,796

(22) PCT Filed: Jul. 22, 2008

(86) PCT No.: PCT/JP2008/063129

§ 371 (c)(1), (2), (4) Date: Feb. 2, 2010

(87) PCT Pub. No.: WO2009/028277

PCT Pub. Date: Mar. 5, 2009

(65) Prior Publication Data

US 2011/0226500 A1 Sep. 22, 2011

(30) Foreign Application Priority Data

Aug. 30, 2007 (JP) ..... 2007-224678

(51) Int. Cl.
*B25D 1/12* (2006.01)

(52) U.S. Cl. ..... 173/110; 173/104; 173/109

(58) Field of Classification Search ..... 173/104, 173/109, 48, 201, 110
See application file for complete search history.

(56) References Cited

U.S. PATENT DOCUMENTS

| | | | | | |
|---|---|---|---|---|---|
| 287,333 | A | * | 10/1883 | Seymour | 74/570.21 |
| 1,482,507 | A | * | 2/1924 | Cohn | 60/370 |
| 1,800,465 | A | * | 4/1931 | Miller et al. | 173/14 |
| 1,901,779 | A | * | 3/1933 | Skeel et al. | 74/583 |
| 2,091,408 | A | * | 8/1937 | Lewis | 74/583 |
| 2,171,946 | A | * | 9/1939 | Palmros | 173/201 |
| 2,638,749 | A | * | 5/1953 | Sparano | 60/542 |
| 3,275,088 | A | * | 9/1966 | Schrottle | 173/110 |
| 3,299,967 | A | * | 1/1967 | Cabot et al. | 173/201 |
| 3,305,031 | A | * | 2/1967 | Bez et al. | 173/115 |

FOREIGN PATENT DOCUMENTS

| | | |
|---|---|---|
| EP | 1 439 038 A1 | 7/2004 |
| EP | 1 736 283 A2 | 12/2006 |
| JP | A-51-6583 | 1/1976 |
| JP | A-56-9180 | 1/1981 |
| JP | A-60-94281 | 5/1985 |
| WO | WO 2004/082897 A1 | 9/2004 |

OTHER PUBLICATIONS

International Search Report for International Application No. PCT/JP2008/063129, issued Oct. 28, 2008.

Search Report issued in European Patent Application No. EP 08 79 1410 mailed Jan. 2, 2012.

* cited by examiner

*Primary Examiner* — Sameh H. Tawfik
*Assistant Examiner* — Nathaniel Chukwurah
(74) *Attorney, Agent, or Firm* — Oliff & Berridge, PLC

(57) ABSTRACT

In an upper surface of a crank housing is provided an inlet for grease which is configured to be openable and closable by a cap. A vibration damping mechanism, which includes a counterweight provided with a connecting pin loosely fitted in a connecting hole of an eccentric pin when the cap is attached, is mounted in the cap, whereby the vibration damping mechanism is allowed to be taken in and out of the crank housing through the inlet by attachment and detachment of the cap to and from the inlet.

13 Claims, 3 Drawing Sheets

(A)

(B)

IMPACT TOOL

TECHNICAL FIELD

This invention relates to an impact tool such as an electric hammer, a hammer drill, and the like.

BACKGROUND ART

The impact tool comprises an impact mechanism provided within a housing. The impact mechanism includes a piston for causing an impactor to move in accordance with its motion, thereby directly or indirectly striking a bit installed at an end of the housing. The reciprocating motion of the impactor is obtained by converting a rotation of a motor-driven crank shaft into a reciprocating motion of the piston by means of a crank mechanism in which an eccentric pin provided on the crank shaft is connected to the piston by a connecting rod.

Optionally, the impact tool may also comprise a vibration damping mechanism provided to reduce vibration generated by a striking operation of the impact tool. This vibration damping mechanism typically has a well-known configuration, for example, as illustrated in Patent Document 1, such that a rotary plate is mounted on the eccentric pin of the crank shaft, a second pin is provided protrusively on an upper side of the rotary plate in a position point-symmetric to the eccentric pin, and a counterweight is connected via a rod or the like to the second pin. That is, the shift in the center of gravity, derived from the reciprocating motion of the piston, is canceled out by the reversely moving counterweight, so that the vibration can be reduced.

Patent Document 1: Japanese Laid-Open Utility Model Application, Publication No. 51-6583

DISCLOSURE OF INVENTION

Problems to be Solved by the Invention

In the impact tool as described above, an inlet for grease to be supplied to the impact mechanism and/or the crank mechanism for lubricatory and other purposes is provided in a position above the crank mechanism in the housing, and configured to be openable and closeable by a cap. In the vibration dumping mechanism as described above, however, the rod and the counterweight protrude rearwardly far beyond the inlet, and thus cannot be taken in and out through the inlet even when the cap has been removed. Therefore, even a simple operation such as replacement of parts would disadvantageously require much expense in time and effort, because the housing should be disassembled beforehand when a previously mounted vibration damping mechanism is removed from the product, or conversely when a vibration damping mechanism is mounted into the product.

Furthermore, in order to allow enough space for the counterweight rearwardly protruding far beyond as described above to move, the housing should be specifically designed to have a special shape such that the tool as a whole would become upsized and the housing could not be utilized commonly for the impact tool having no vibration damping mechanism, which would resultantly increase the cost. In particular, the exchangeability of parts, of the crank mechanism would be limited due to a large rotary plate mounted on the eccentric pin, which would further increase the cost and the expense in time and effort for parts management in that reconfiguration should be performed depending upon the presence or absence of the vibration damping mechanism.

With this in view, it is an object of the present invention to provide an impact tool in which a vibration damping mechanism can easily be taken in and out through an inlet for grease, without upsizing the housing, and exchangeability of the parts of the housing and other components can be retained.

Means for Solving the Problems

In order to achieve the above object, the invention as set forth in claim 1 provides an impact tool which comprises: an impact mechanism provided in a housing and comprising an impactor for use in striking a bit and a piston configured to cause the impactor to move in accordance with a motion of the piston; a crank mechanism in which an eccentric pin provided at a motor-driven rotatable crank shaft is connected to the piston by a connecting rod, to convert a rotation of the crank shaft into a reciprocating motion of the piston; a vibration damping mechanism configured to operate in synchronization with the crank mechanism to reduce vibration by canceling out a shift in the center of gravity derived from the reciprocating motion of the piston; and an inlet for grease, formed above the crank mechanism in the housing, and configured to be closed by a cap that is attachable to and detachable from the inlet, wherein at least part of the vibration damping mechanism is mounted to the cap in such a manner that attachment of the cap brings the vibration damping mechanism being capable of moving in synchronization with the crank mechanism, the at least part of the vibration damping mechanism being allowed to be taken in and out of the housing through the inlet by attachment and detachment of the cap to and from the inlet.

In this configuration, preferably, the vibration damping mechanism may comprise a counterweight which is rotatably mounted in the cap, has at a first end thereof a weight portion, and is smaller than the cap; one of a second end of the counterweight and the eccentric pin has a connecting hole, and the other of the second end of the counterweight and the eccentric pin has a connecting pin which is caused to put in and pulled out of the connecting hole by the attachment and detachment of the cap; and when the cap is attached, the counterweight is connected to the eccentric pin in such a manner that the counterweight makes a rotatory motion such that the counterweight comes in a position opposite to that of the piston with respect to a front-rear direction.

Alternatively, the vibration damping mechanism may preferably comprise a counterweight which is mounted movably in a front-rear direction in the cap, and a connecting member which is connected to the eccentric pin at an edge of the inlet in the housing and configured to be rotatable coaxially with the crankshaft in accordance with a circular movement of the eccentric pin; the counterweight has a connecting hole extending in a lateral direction, and the connecting member has a connecting pin which is disposed in a position opposite to that of the eccentric pin in the front-rear direction with respect to a center of rotation of the connecting member and caused to be put in and pulled out of the connecting hole by the attachment and detachment of the cap; and when the cap is attached, the counterweight is connected to the connecting member in such a manner that the counterweight makes a front-rear reciprocating motion such that the counterweight is in a position opposite to that of the piston with respect to the front-rear direction.

Advantageous Effects of the Invention

According to the present invention, the operability for repairs, maintenance, etc. of the vibration damping mechanism is improved. Moreover, part or entirety of the vibration damping mechanism is incorporated in the cap, and thus commonly available parts can be used for most parts of the housing and the crank mechanism except for the cap, irrespective of the presence or absence of the vibration damping mechanism. Therefore, the upsizing of the tool can be prevented, and the exchangeability of parts can be retained, with the result that the increase in cost can be suppressed and the expense in time and effort for parts management can be minimized. Furthermore, the vibration damping mechanism can easily be added to the existing impact tool having no vibration damping mechanism.

BEST MODE FOR CARRYING OUT THE INVENTION

Embodiments of the present invention will be described hereinafter with reference to the accompanying drawings.

[Embodiment 1]

In FIG. 1, which is a diagram for explaining an electric hammer as one example of an impact tool, an electric hammer 1 is configured such that a crank housing 5 in which a crank mechanism 6 is incorporated is mounted on top of a motor housing 2 which accommodates a motor 3 having an output shaft 4 oriented upward, and a cylindrical barrel 7 in which an impact mechanism 8 is incorporated is mounted to a front side (left side of FIG. 1) of the crank housing 5. Denoted by reference numeral 9 is a handle mounted to a rear side of the motor housing 2 and the crank housing 5.

The crank mechanism 6 includes a crank shaft 10 rotatably supported parallel to the output shaft 4. The crank shaft 10 has a gear II which is provided at an upper portion thereof and is in mesh with a pinion of the output shaft 4. An eccentric pin 12 protrusively provided on an upper surface of the crank shaft 10 is connected to a piston 15 of the impact mechanism 8 through a connecting rod 13, whereby the rotation of the crank shaft 10 is converted to a reciprocating motion of the piston 15.

The impact mechanism 8 has a known structure comprising a cylinder 14 which is held in the barrel 7 and in which the piston 15 and an impactor 17 disposed frontwardly thereof are accommodated with an air chamber 16 interposed therebetween in such a manner that the piston 15 and the impactor 17 are movable in a front-rear direction, respectively, and an interjacent element 18 disposed frontwardly of the impactor 17. A tool retainer 20 in which a bit 19 is to be installed is provided at a front end of the barrel 7.

Accordingly, when the motor 3 is driven to cause the output shaft 4 to make a rotation which is transmitted via the gear 11 to cause the crank shaft 10 to rotate, the piston 15 makes a reciprocating motion which in turn causes the impactor 17 to reciprocate by the action of air spring of the air chamber 16 and strike a rear end of the interjacent element 18 thrust to protrude into the cylinder 14 as a result of installation of the bit 19. In this way, the bit 19 is struck indirectly through the interjacent element 18 by the impactor 17.

On the other hand, a circular inlet 21 for grease is formed in an upper surface of the crank housing 5, as shown in FIG. 2 (A) as well. At the inlet 21, a cap 22 which can be fixed with a bolt 23 is attached, in such a manner that the inlet 21 can be opened by removing the cap 22, as desired. At the center of the cap 22, a through hole 24 is formed, and the vibration damping mechanism 25 is mounted in the through hole 24. As shown in FIG. 2 (B) as well, the vibration damping mechanism 25 comprises a generally plate-like counterweight 26 which is bent in the shape of a letter L with a fan-shaped weight portion 27 provided at one end as viewed from above and of which the overall dimension is smaller than the opening of the inlet 21, and ball bearings 29 by which an upwardly protruding shaft portion 28 of the counterweight 26 is rotatably held inside the through hole 24. By fixing a washer 31 with a screw 30 at the shaft portion 28 from upward, the counterweight 26 is rotatably mounted to the cap 22 with the shaft portion 28 located above and coaxially with the crank shaft 10. Denoted by reference numeral 32 is a dustproof cap for closing the through hole 24 of the cap 22 from above.

In a portion of the counterweight 26 closer to its end opposite to the end at which the weight portion 27 is provided, a connecting pin 33 is press-fitted downward, and the lower end of the connecting pin 33 is loosely fitted in a connecting hole 34 provided at the center of an upper end face of the eccentric pin 12 of the crank shaft 10. Accordingly, when the crank shaft 10 rotates and causes the eccentric pin 12 to make a circular movement, the counterweight 26 is also caused, via the connecting pin 33, to rotate about the shaft portion 28 coaxially with the crank shaft 10. In this embodiment, the weight portion 27 of the counterweight 26 is configured to be in a position phase shifted in an advanced direction of rotation (counterclockwise in FIG. 2 (B)) when the eccentric pin 12 is in the frontmost position as shown in FIG. 1, so that a shift in the center of gravity derived from the reciprocating motion of the piston 15 is canceled out by the weight portion 27. In this way, the phase of the weight portion 27 of the counterweight 26 is configured not to be diametrically opposite to that of the piston 15 but to be shifted to an advanced position forward in the direction of rotation, because there exists a time lag between the reciprocating motion of the piston 15 and the motion of the impactor 17, and thus the shift in the center of gravity precedes the reciprocating motion of the piston 15.

In the electric hammer 1 configured as described above, when the bolt 23 is loosened and the cap 22 is removed from the inlet 21, the counterweight 26 mounted to the cap 22 is also removed from inside the crank housing 5 through the inlet 21 as the connecting pin 33 is pulled out of the connecting hole 34 of the eccentric pin 12. This allows replacement, repairs, etc. of the parts in the vibration damping mechanism 25. To attach the cap 22 back to the inlet 21, the cap 22 with the connecting pin 33 of the counterweight 26 aligned with the connecting hole 34 of the eccentric pin 12 is placed over the inlet 21, so that when the cap 22 is fixed, simultaneously, the connecting pin 33 is loosely fitted into the connecting hole 34 and the counterweight 26 is coupled with the eccentric pin 12.

In this way, with the electric hammer 1 implemented according to the above-described embodiment 1, the vibration damping mechanism 25 is mounted to the cap 22 in such a manner as to operate in synchronization with the crank mechanism 6 when the cap 22 is attached, so that the vibration damping mechanism 25 can be caused to be taken in and out of the crank housing 5 through the inlet 21 by attachment and detachment of the cap 22 to and from the inlet 21. As a result, the operability for repairs, maintenance, etc. of the vibration damping mechanism 25 is improved. Moreover, the whole vibration damping mechanism 25 is incorporated in the cap 22, and thus commonly available parts can be used for components other than the cap 22, such as the crank housing 5 and the crank mechanism 6, irrespective of the presence or absence of the vibration damping mechanism 25. Therefore, the upsizing of the tool can be prevented, and the exchangeability of parts can be retained, with the result that the increase in cost can be suppressed and the expense in time and effort for parts management can be minimized. Furthermore, the vibration damping mechanism can easily be added to the existing electric hammer or the like having no vibration damping mechanism.

In this embodiment, particularly, the vibration damping mechanism 25 is configured to include the counterweight 26 which is rotatably mounted in the cap 22, has at one end thereof the weight portion 27, and is smaller than the cap 22; the other end of the counterweight 26 has the connecting pin 33, and the eccentric pin 12 has the connecting hole 34; and when the cap 22 is attached, the counterweight 26 is connected to the eccentric pin 12 in such a manner that the counterweight 26 makes a rotatory motion such that the counterweight 26 comes in a position opposite to that of the piston 15 with respect to a front-rear direction. With this configuration, the entirety of the vibration damping mechanism 25 can be taken in and out through the inlet 21, and switching between an interlocking state in which the vibration damping mechanism 25 is interlocked with the crank mechanism 6 and an uninterlocked state in which such an interlocked state is released can easily be done by taking the vibration damping mechanism 25 in and out.

In the embodiment 1, the connecting pin and the connecting hole are provided in the counterweight and the eccentric pin, respectively; however, the pin and the hole may change places with each other. The structures for mounting the counterweight to the cap is not limited to the aforementioned configuration, but any modifications may be made, for example, such that the shaft portion is embodied as a discrete member such as a pin to which the counterweight is rotatably attached.

Furthermore, the shape of the cap is not limited to such a circular shape, but any other shape, such as a rectangle, contoured to fit the shape of the inlet may be adopted. The shape of the counterweight may be changed where appropriate.

[Embodiment 2]

Next, another embodiment of the present invention will be described. However, the same elements as in the embodiment 1 will be designated by the same reference characters and a duplicate description will be omitted; thus, our discussion will mainly be focused on the vibration damping mechanism.

FIG. 3 is a diagram for explaining a portion of a hammer drill 1*a* as one example of an impact tool, which includes a crank mechanism; a longitudinal section is shown on the left side, an A-A cross section on the right side, and a plan view of a portion within a cap on the upper side.

This hammer drill 1*a* comprises a tool holder 40 holding a cylinder 14 and having a bit attached at an end thereof, the tool holder 40 is rotatably held within a barrel 7, and a rotation of an intermediate shaft 42 transmitted from an output shaft 4 is transmitted to the tool holder 40, through a bevel gear 41 which is coupled with a peripheral surface of a rear end portion of the tool holder 40 and with which a bevel gear formed at an upper end portion of the intermediate shaft 42 provided frontwardly of the output shaft 4 and parallel to the output shaft 4 is engaged, so that a bit 19 can be rotated.

On the other hand, on an upper surface of the crank housing 5 of the hammer drill 1*a*, a rectangular inlet 21 is formed, and a cap 22 shaped like a shallow pan having a rectangular profile as viewed from above is detachably attached to the inlet 22 with a bolt 23.

The vibration damping mechanism 43 as used herein comprises a counterweight 44 which is mounted in the cap 22, and a connecting member 46 which is disposed in a circular hole 45 formed at an edge of an opening of the inlet 21 in the crank housing 5 and connected with an eccentric pin 12 and the counterweight 44.

First, the counterweight 44 is a block through which a pair of guide pins 47, 47 mounted in the cap 22 and oriented in a front-rear direction are pierced and which is thereby slidably held in the front-rear direction within the cap 22, and a connecting hole 48 oriented in a lateral direction is provided in a rear portion thereof.

Next, the connecting member 44 is rotatably held coaxially with the crank shaft 10, by ball bearings 49 provided at the circular hole 45, and an upper end of a small-diameter pin 51 inserted coaxially with the eccentric pin 12 is fitted in a recess 50 formed in a position located off the center of rotation at a lower side thereof, so that a circular motion of the eccentric pin 12 can be transmitted to the connecting member 46. In the connecting member 46, a connecting pin 52 is further provided in a position opposite to that of the recess 50 in the front-rear direction with respect to the center of rotation. The connecting pin 52 protruding upward is disposed through a bush 53 and loosely fitted in the connecting hole 48 of the counterweight 44. Accordingly, as the connecting pin 52 makes a circular movement, the counterweight 44 slides frontward and rearward, at a stroke corresponding to the amount of movement thereof in the front-rear direction, as indicated by chain double-dashed lines. In this embodiment, as in the embodiment 1, with consideration given to a time lag in motion between the piston 15 and the impactor 17, when the piston 15 and the eccentric pin 12 are in the frontmost position, the connecting pin 52 is shifted to an advanced position forward in the direction of rotation, and thus the counterweight 44 is located in a position slightly shifted frontward from the rearmost position. It is however to be noted that the positions of the connecting pin 52 and the counterweight 44 in FIG. 3 are shown in the rearmost positions, for the convenience of explanation of their structures.

In the hammer drill 1*a* configured as described above, when the bolt 23 is loosened and the cap 22 is removed from the inlet 21, the counterweight 44 integrally formed therewith is also taken out as it is as the connecting hole 48 is separated from the connecting pin 52. In this case, the connecting member 46 and the ball bearings 49 are left in the circular hole 45, but exposed at the edge of the opening of the inlet 21, and thus can be taken out easily. This configuration therefore allows replacement, repairs, etc. of the parts in the vibration damping mechanism 43. To mount the vibration damping mechanism 43 back, the connecting member 46 and the ball bearings 49 are mounted in the circular hole 45 with the recess 50 aligned with the small-diameter pin 51 of the eccentric pin 12, and then the cap 22 with the connecting hole 48 of the counterweight 44 aligned with the connecting pin 52 of the connecting member 46 is placed over the inlet 21, so that the counterweight 44 is coupled with the connecting pin 52.

In this way, with the hammer drill 1*a* implemented according to the above-described embodiment 2, as well, part (counterweight 44) of the vibration damping mechanism 43 can be taken in and out through the inlet 21, and therefore the operability for repairs, maintenance, etc. of the vibration damping mechanism is improved. Moreover, the counterweight 44 is incorporated in the cap 22, and the crank housing 5 may be embodied merely with a slight modification in shape by which a circular hole 4 for holding the connecting member 46 is formed, and thus commonly available parts can be used for components other than the cap 22, such as the crank housing 5 and the crank mechanism 6, irrespective of the presence or absence of the vibration damping mechanism 43. Therefore, the upsizing of the tool can be prevented, and the exchangeability of parts can be retained, with the result that the increase in cost can be suppressed and the expense in time and effort for parts management can be minimized.

Particularly, the vibration damping mechanism 43 comprises the counterweight 44 which is mounted movably in a front-rear direction in the cap 22, and the connecting member 46 connected to the eccentric pin 12 at an edge of the inlet 12 in the crank housing 5, and configured to be rotatable coaxially with the crankshaft 10 in accordance with a circular movement of the eccentric pin 12; the counterweight 44 has a connecting hole 48 extending in a lateral direction, and the connecting member 46 has a connecting pin 52 which is disposed in a position opposite to that of the eccentric pin 12 in the front-rear direction with respect to a center of rotation thereof and caused to be put in and pulled out of the connecting hole 48 by the attachment and detachment of the cap 22; and when the cap 22 is attached, the counterweight 44 is connected to the connecting member 46 in such a manner that the counterweight 44 makes a front-rear reciprocating motion such that the counterweight 44 is in a position opposite to that of the piston 15 with respect to the front-rear direction, so that even when part of the vibration damping mechanism 43 is allowed to be taken in and out through the inlet 21, switching between an interlocking state in which the vibration damping mechanism 43 is interlocked with the crank mechanism 6 and an uninterlocked state in which such an interlocked state is released can easily be done by taking the vibration damping mechanism 43 in and out.

In the embodiment 2, as well, modifications may be made, for example, such that the number of the guide pins are increased or reduced, or the guide pins are replaced with grooves provided on left and right inner surfaces of the cap which are engageable with ridges provided on left and right side surfaces of the counterweight so that the counterweight can be slid frontward and rearward. Moreover, the structures for connecting the connecting member with the eccentric pin may be configured such that a pin provided on a lower surface of the connecting member is loosely fitted in a hole having a bottom provided on an upper end of the eccentric pin, as contrary to the above-described embodiment.

Furthermore, in this embodiment as well, the cap may have any shape other than a rectangle, such as a circle, etc.

In the embodiments 1 and 2, with consideration given to a time lag in motion between the piston and the impactor, the weight portion of the counterweight or the connecting pin is not in point-symmetric to the eccentric pin, but shifted forward in the direction of rotation; however, it may be point-symmetrically phased with the eccentric pin depending upon the model of tool.

Moreover, the present invention may be applicable to a various types of impact tool; for example, the vibration damping mechanism as in the embodiment 1 may be used in a hammer drill as in the embodiment 2, whereas the vibration damping mechanism as in the embodiment 2 may be used in an electric hammer as in the embodiment 1.

EXPLANATION OF REFERENCE CHARACTERS

Figure 1:
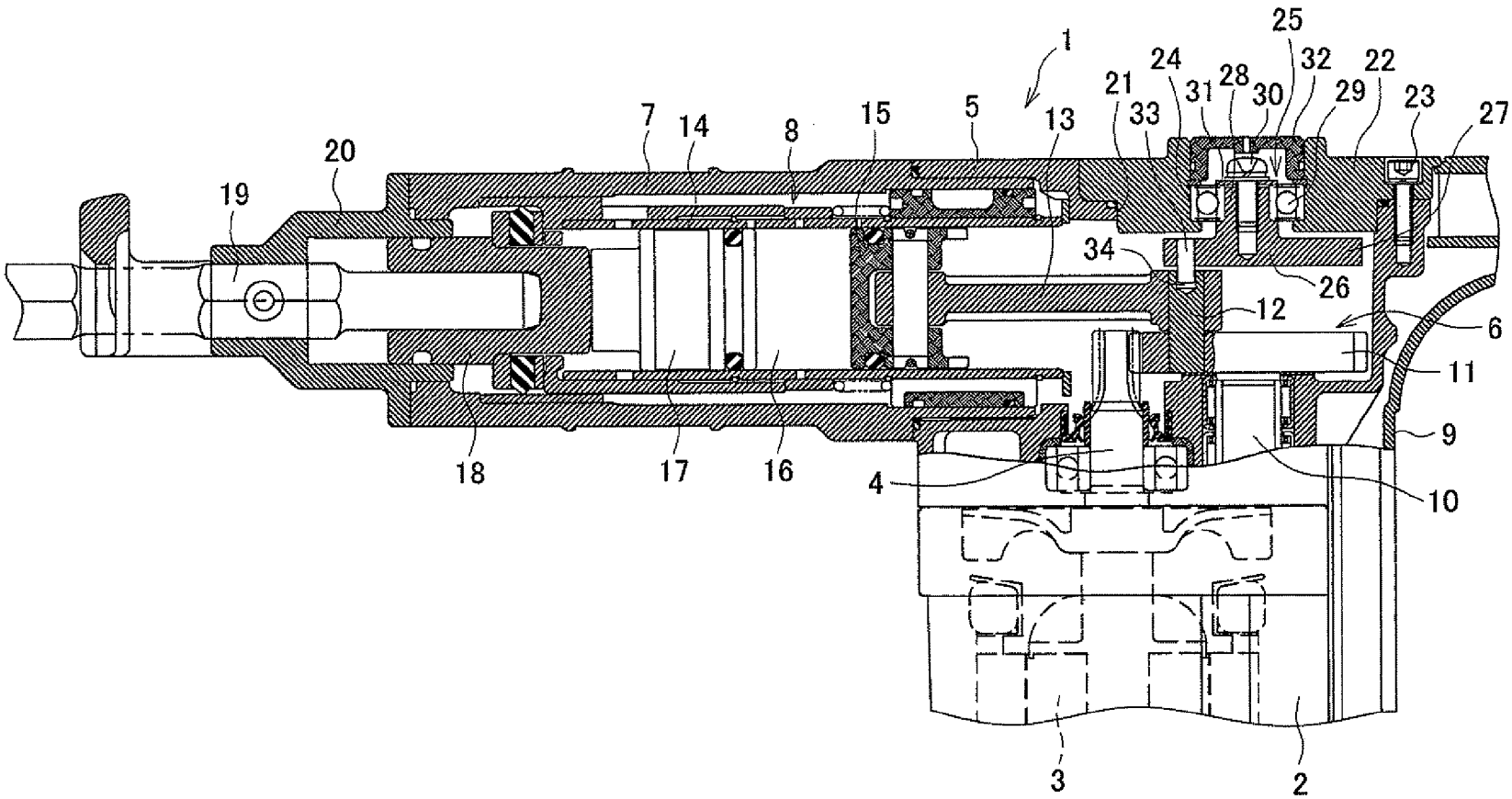
FIG. 1 is a diagram for explaining an electric hammer according to an embodiment 1.
Figure 2:
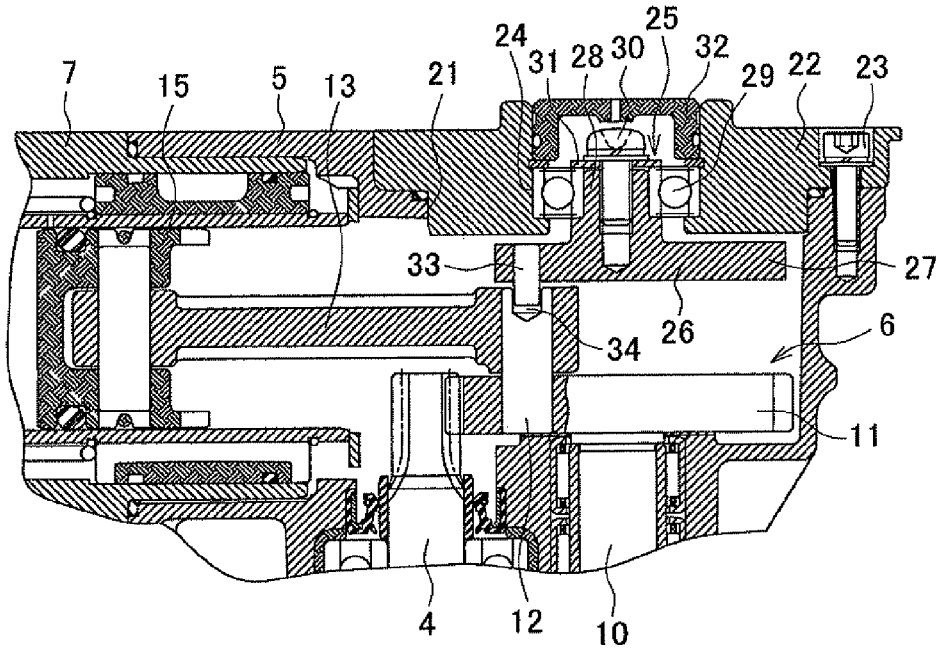
FIG. 2 (A) is a longitudinal section of a portion which includes a vibration damping mechanism, and (B) is a diagram for explaining a counterweight.
Figure 2:
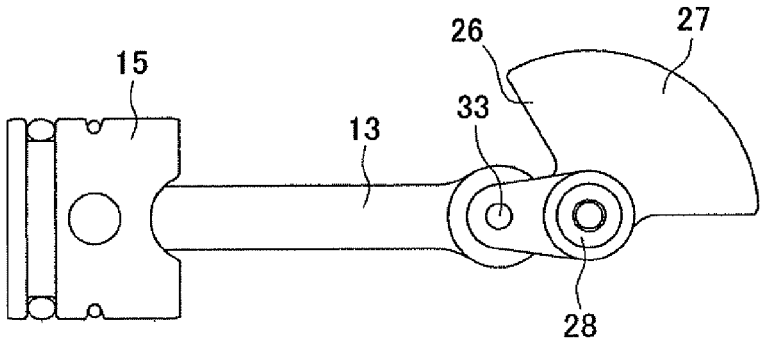
Figure 3:
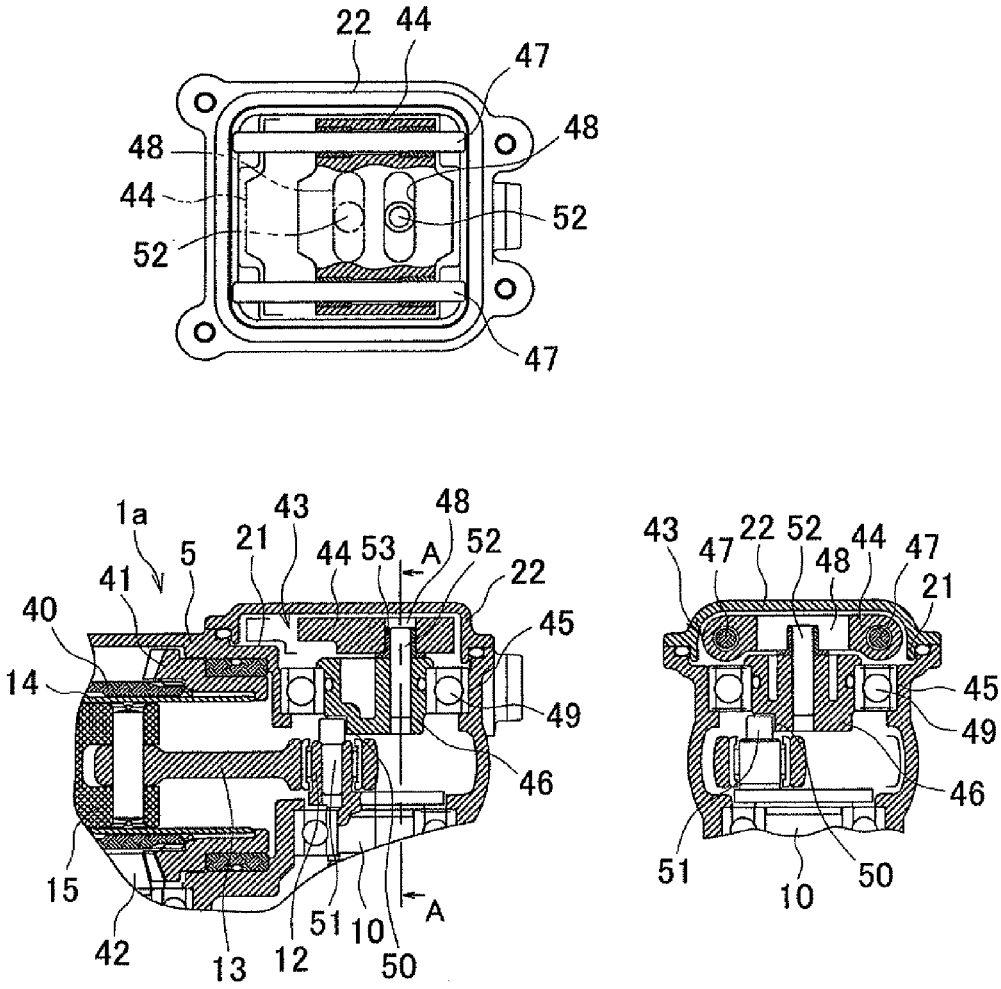
FIG. 3 is a diagram for explaining a portion of a hammer drill according to an embodiment 2, which includes a vibration damping mechanism.

1—ELECTRIC HAMMER, 1*a*—HAMMER DRILL, 2—MOTOR HOUSING, 3—MOTOR, 4—OUTPUT SHAFT, 5—CRANK HOUSING, 6—CRANK MECHANISM, 7—BARREL, 8—IMPACT MECHANISM, 10—CRANK SHAFT, 12—ECCENTRIC PIN, 13—CONNECTING ROD, 14—CYLINDER, 15—PISTON, 17—IMPACTOR, 19—BIT, 21—INLET, 22—CAP, 24—THROUGH HOLE, 25, 43—VIBRATION DAMPING MECHANISM, 26, 44—COUNTERWEIGHT, 27—WEIGHT PORTION, 28—SHAFT PORTION, 33, 52—CONNECTING PIN, 34, 48 CONNECTING HOLE, 45—CIRCULAR HOLE, 46—CONNECTING MEMBER, GUIDE PIN.

The invention claimed is:

1. An impact tool comprising:

an impact mechanism provided in a housing and comprising an impactor configured to strike a bit and a piston configured to cause the impactor to move in accordance with a motion of the piston;

a crank mechanism in which an eccentric pin provided at a motor-driven rotatable crank shaft is connected to the piston by a connecting rod so as to convert a rotation of the crank shaft into a reciprocating motion of the piston;

a vibration damping mechanism including a counterweight configured to move in synchronization with the crank mechanism so as to reduce vibration by canceling out a shift in the center of gravity derived from the reciprocating motion of the piston; and an inlet configured to serve as a channel for grease, the inlet formed above the crank mechanism in the housing and configured to be closed by a cap that is attachable to and detachable from the inlet, wherein at least part of the vibration damping mechanism, the at least part of the vibration damping mechanism including the counterweight, is mounted to the cap in such a manner that attachment of the cap brings the at least part of the vibration damping mechanism into the housing, the at least part of the vibration damping mechanism configured to be taken in and out of the housing through the inlet with attachment and detachment of the cap to and from the inlet.

2. The impact tool according to claim 1, wherein the counterweight, which is smaller than the cap and which is rotatably mounted in the cap, has at a first end thereof a weight portion;

one of a second end of the counterweight and the eccentric pin has a connecting hole, and the other of the second end of the counterweight and the eccentric pin has a connecting pin which is configured to be put in and pulled out of the connecting hole with the attachment and detachment of the cap; and when the cap is attached, the counterweight is configured to be connected to the eccentric pin in such a manner that the counterweight makes a rotatory motion such that the counterweight comes in a position opposite to that of the piston with respect to a front-rear direction.

3. The impact tool according to claim 2, wherein the counterweight has a shaft portion protruding upwardly and disposed through ball bearings held in a through hole provided at a center of the cap, wherein a washer is disposed at an upper end of the shaft portion and fixed with a screw applied from upward, whereby the counterweight is rotatably mounted in the cap.

4. The impact tool according to claim 3, wherein a dust-proof cap closing the through hole of the cap from above is provided at the through hole.

5. The impact tool according to claim 2, wherein the counterweight is bent with the first and second ends oriented to directions forming an obtuse angle as viewed from above such that the weight portion of the first end is phase shifted in an advanced direction of rotation.

6. The impact tool according to claim 2, wherein the weight portion is shaped like a plate widening gradually toward an end thereof as viewed from above.

7. The impact tool according to claim 1, wherein the counterweight which is mounted movably in a front-rear direction in the cap, and a connecting member which is connected to the eccentric pin at an edge of the inlet in the housing and configured to be rotatable coaxially with the crankshaft in accordance with a circular movement of the eccentric pin;

the counterweight has a connecting hole extending in a lateral direction, and the connecting member has a connecting pin which is disposed in a position opposite to that of the eccentric pin in the front-rear direction with respect to a center of rotation of the connecting member and caused to be put in and pulled out of the connecting hole by the attachment and detachment of the cap; and when the cap is attached, the counterweight is connected to the connecting member in such a manner that the counterweight makes a front-rear reciprocating motion such that the counterweight is in a position opposite to that of the piston with respect to the front-rear direction.

8. The impact tool according to claim 7, wherein the counterweight includes a block retained slidably in the front-rear direction in the cap by a pair of guide pins which are inserted through the block, the guide pins being oriented in the front-rear direction and mounted in the cap.

9. The impact tool according to claim 7, wherein the connecting member has a recess formed in a position located off the center of rotation at a lower side thereof, a small-diameter pin inserted coaxially with the eccentric pin has an upper end portion fitted in the recess whereby the connecting member is rendered rotatable in accordance with the circular movement of the eccentric pin, and the connecting pin is disposed in a position opposite to that of the recess in the front-rear direction with respect to the center of rotation.

10. The impact tool according to claim 7, wherein when the piston and the eccentric pin are in frontmost positions, the connecting pin is advanced in phase to a position forward to some extent in a direction of rotation and the counterweight is in a position frontward to some extent relative to a rearmost position thereof.

11. The impact tool according to claim 7, wherein the inlet has a rectangular shape, and the cap is shaped like a shallow pan having a rectangular shape as viewed from above.

12. The impact tool according to claim 1, wherein the impact mechanism comprises a cylinder which is held in the housing and in which the piston and the impactor disposed frontwardly thereof are accommodated with an air chamber interposed therebetween in such a manner that the piston and the impactor are movable in a front-rear direction, respectively, and an interjacent element disposed frontwardly of the impactor and configured to come in contact with the bit.

13. The impact tool according to claim 1, comprising a tool holder which has an end portion configured to hold the bit and is configured to hold a cylinder accommodating the piston, wherein the tool holder is rotatably provided in the housing, and a rotation of the motor is transmitted to the tool holder so that the bit is rotatable.

* * * * *